US005517793A

United States Patent [19]

Flores et al.

[11] Patent Number: 5,517,793

[45] Date of Patent: May 21, 1996

[54] SYSTEM FOR PROTECTING FIREPLACES AND CHIMNEYS FROM ADVERSE SEISMIC OR WIND FORCES

[76] Inventors: Ramond H. Flores, 2268 Lagoon View Dr., San Diego, Calif. 92007; Doug R. Antolini, 3325 Mt. Everest Blvd., San Diego, Calif. 92111-3939

[21] Appl. No.: 998,366

[22] Filed: Dec. 30, 1992

[51] Int. Cl.[6] ..... E04B 1/98

[52] U.S. Cl. ..... 52/167.1; 52/148; 52/223.1; 52/223.4

[58] Field of Search ..... 52/167 R, 167 CB, 52/223.1, 223.4, 223.5, 148, 166, 745.04, 745.09, 745.17, 745.18

[56] References Cited

U.S. PATENT DOCUMENTS

| | | | |
|---|---|---|---|
| 501,811 | 7/1893 | Stombaugh | 52/223.1 X |
| 937,299 | 10/1909 | Foster | 52/223.4 |
| 1,250,167 | 12/1917 | Head | 52/223.4 X |
| 2,401,799 | 6/1946 | Riemenschneider et al. | 52/223.4 X |
| 2,923,382 | 2/1960 | Heldstab | 52/148 |
| 3,174,589 | 3/1965 | Chen | 52/167 R |
| 3,237,355 | 3/1966 | McWtyre | 52/148 |
| 3,780,480 | 12/1973 | Cvijanovic et al. | 52/223.4 |
| 4,321,776 | 3/1982 | Delight | 52/167 R |
| 5,085,026 | 2/1992 | McGill et al. | 52/167 R X |

*Primary Examiner*—Philip C. Kannan

[57] ABSTRACT

A system for improving the horizontal fracture resistance of older chimneys and fireplaces comprised of units of brick, stone, and the like, in response to seismic, wind, and other external lateral forces, by placing the units under a vertical internal compression stress, increasing the shear capacity between the units, by means of a clamping action. Said clamping action is the results of providing one or more elongated members attached to an element affixed at the top of the chimney and an element affixed at a lower level, said elongated members being placed under predetermined tension creating a vertical internal compression stress.

13 Claims, 5 Drawing Sheets

SYSTEM FOR PROTECTING FIREPLACES AND CHIMNEYS FROM ADVERSE SEISMIC OR WIND FORCES

BACKGROUND OF THE INVENTION

This invention relates to the protection of chimneys in general and fireplace chimneys in particular against seismic or wind forces and, more particularly, to a system which can be applied to older existing stone, brick, block, and the like chimneys and fireplaces to provide such protection.

Modern fireplace chimneys constructed over the last several years in areas prone to seismic activity or high winds are provided with protection against those forces. Sturdy foundations and a variety of systems for tieing the fireplace and their chimney's to the structure are generally provided, as generally required by modern building codes.

Older fireplace chimneys are generally inadequately constructed and are prone to movement and collapse during an earthquake or high winds. This is usually due to factors such as aging, corrosion, deterioration of materials such as mortar and grout and improper installation, etc. Retrofitting these existing chimneys and their fireplaces to the standards for new construction is generally prohibitively expensive and/or impractical. Thus, there is a continuing need for improved, inexpensive, and effective systems for protecting existing stone, brick, and block chimneys.

This invention provides a system for retrofitting or mitigating against damage from seismic or wind forces.

SUMMARY OF THE INVENTION

Modern chimneys contain reinforcement, anchorage, and foundations which resist horizontal fracturing, as well as, lateral displacement from earthquakes or high wind forces. Older chimneys usually lack such modern reinforcement, anchorage, and foundation and are prone to damage when subjected to seismic or wind forces. Such chimneys, in general, do not conform to modern building codes.

This invention is a system comprised of three structural strengthening elements. One, is a clamping element which resists horizontal fracturing. The second, is the bracing element which resists lateral displacement. And, the third, is the horizontal extending foundation element which also resists lateral displacement. These three strengthening elements are summarized herein.

The clamping element results in a vertical internal compression stress from the top portion of the chimney, through the body of the chimney, downward to selected lower levels of the chimney or to the ground level of the chimney by means of one or more elongated tension member attached to the top of the chimney in a suitable manner, i.e., by a collar, girdle, harness or similar means engaging the upper portion of the chimney and anchoring the top end of the tension member thereto, while the lower end of the tension member is attached to selected locations along the lower level of the chimney, i.e. by using a connector or similar means of engaging the lower portion of the chimney and anchoring the bottom end of the tension member thereto, or extending the tension member further down to ground level anchoring attached to plates secured to or suitably positioned into or on the chimney or into cast-in-place concrete foundations or plates secured to or suitably positioned under the foundation of the fireplace or existing structure or straps which extend continuously under the fireplace foundation or earth type anchors and the like and placed under suitable tension. This tension exerts a predetermined degree of downward pressure upon the chimney structure, which determines the degree of internal vertical stress.

The tension member may be tie rods, wire rope, webbing, straps, and the like, with suitable means for providing tension, i.e. such as turnbuckles, rachet, etc.

The tension member should be of suitable properties to provide a predetermined internal stress and able to incorporate a means for applying the tension to the tension member the tension applied to the tension member is of such a magnitude that conformity to applicable building code requirements related to preventing horizontal fracturing is obtained. Such tension has been calculated as sufficient to produce a downward pressure in the range of 20 to 30 pounds per square inch.

In actual practice, the number of such tension members and the angular position thereof, will depend upon the size, shape and position of the chimney. In some cases, a single tension member may suffice. In others, two or more tension members may be required. In most cases, a pair of such members may be sufficient.

BRIEF DESCRIPTION OF THE DRAWINGS

Details of the invention, and of certain preferred embodiments thereof, will be further understood upon reference to the drawings, wherein.

DETAILED DESCRIPTION

Figure 1:
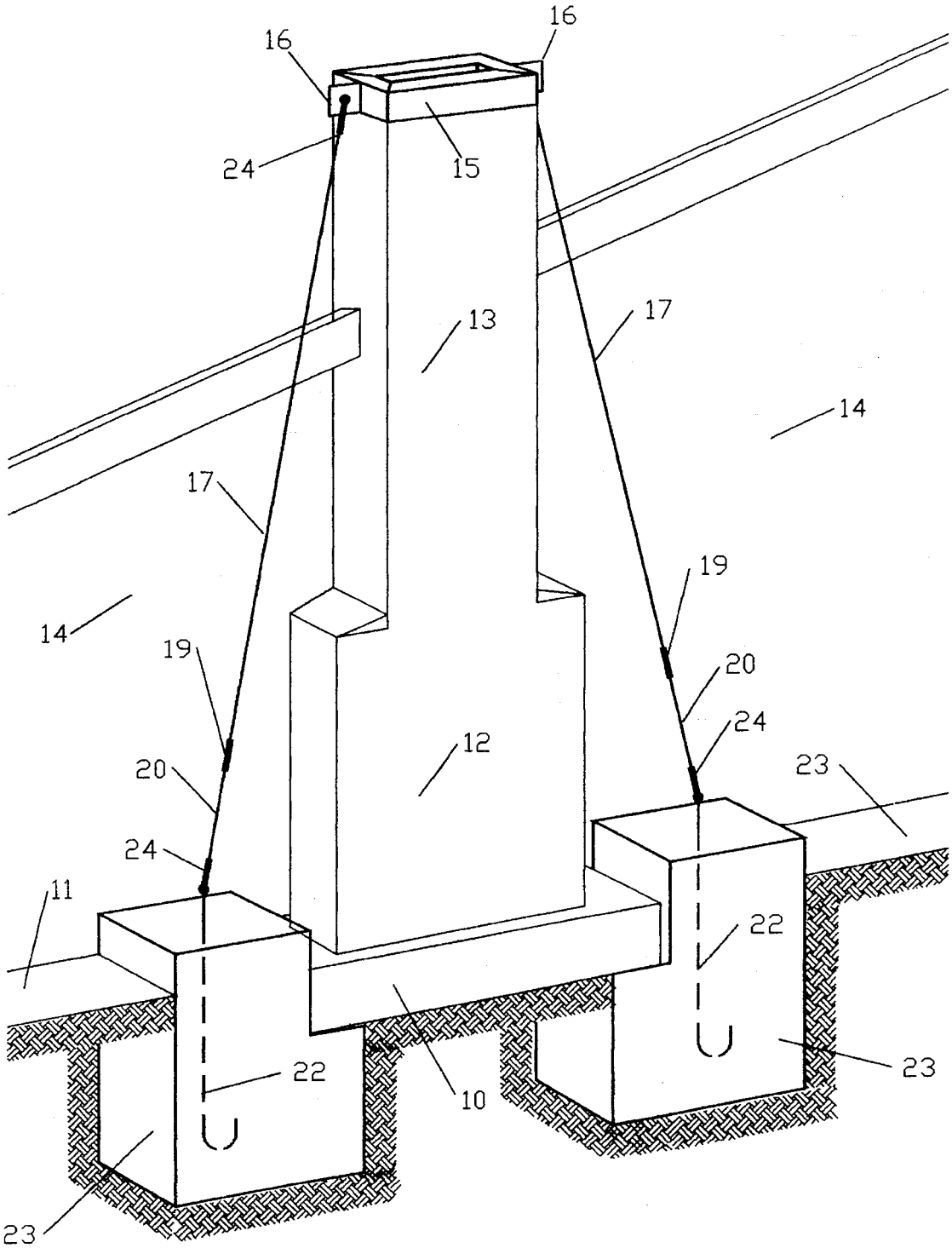
FIG. 1 is an exterior perspective view showing a typical external fireplace chimney installation utilizing one embodiment of the invention using a compression collar over the top of the chimney with tensioning attached thereto.

Referring to FIG. 1, there is seen a fireplace foundation 10 which is independent or monolithic to the structures' foundation 11, formed of concrete. A fireplace exterior wall 12, typically formed of stone, brick, block, or the like, is shown with a continuing chimney wall 13, also formed of stone, brick, block, or the like. The exterior wall of the structure 14 is shown.

Over the top of chimney 13 is shown a compression collar or cap 15, which may be formed of welded or connected steel angles, plates and the like to which compression end connectors 16 are attached. The compression end collar connectors 16, may be formed of welded steel plates, angles, and the like with a hole to receive the tensioning member tie rods 17 and or clevis 24.

The pair of steel tensioning tie rod members 17 have threaded ends attached to the compression end connectors 16 with clevis type connector 24. The rod members 17 are threaded at their lower ends into turnbuckle type tensioners 19. A pair of short, threaded steel adjusting tie rods 20, are threaded into the turnbuckle type tensioners 19 and to clevis type connector 24.

A pair of embedded rod anchors 22, preferably made of steel and the like, with hooked lower ends which are embedded into the anchoring elements 23 and attached to the clevis type connector 24. The pair of anchoring elements 23, are formed of a cast-in-place concrete foundation which receive the rod anchors 22.

By tightening the turnbuckle type tensioners 19, a tension is applied to the long tension tie rods 17, the tie rod tension is resisted by the top collar 15 and the base anchoring element 23, the applied tension causes a clamping action, commonly referred to as post-tensioning in engineering terminology.

Referring to FIGS. 2 through 5, there is shown several alternative ways of attaching the tensioning members to the top of the chimney. In each of these alternates there is seen a chimney wall 13, formed of stone, brick, block, and the like. The exterior wall 14 of the structure is shown. Each of these alternates have a pair of long steel tension tie rods 17 which have threaded ends attached to the compression end connectors 16 with threaded fastener or clevises 24. The lower ends of the tensioning tie rods 17 are attached to the embodiments shown in FIGS. 6 and 9 to 13.

Figure 2:
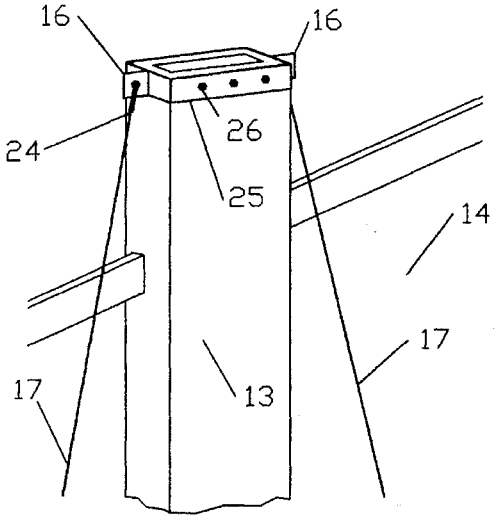
FIG. 2 is a chimney top perspective showing another embodiment of the invention utilizing a circumferential collar at or near the top and attached to the face of the chimney, with tensioning attached thereto.

In FIG. 2 there is seen a circumferential collar 25 attached to the side of the chimney 13, which may be formed of welded or connected steel angles, plates and the like which is attached at or near the top of the chimney with fasteners 26. At the ends of the circumferential collar, compression end connectors 16 are attached. These may be formed of welded steel plates, angles, and the like, with a hole to receive the long tension type tie rods 17 and or clevis 24.

Figure 3:
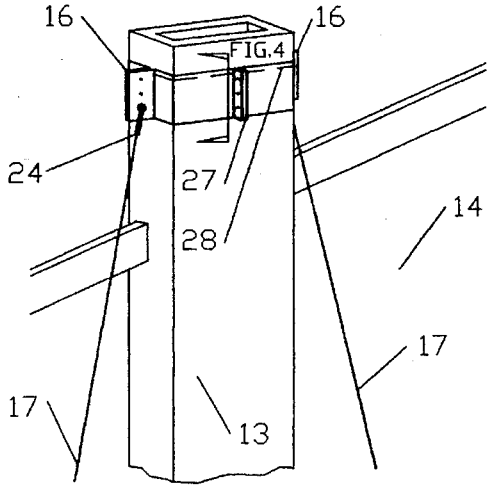
FIG. 3 is a chimney top perspective showing another embodiment of the invention utilizing a sectional circumferential girdle type connector which is placed at or near the top of the chimney. The girdle has a bearing lip which is embedded into the mortar joint or placed over the top of the top of the chimney, with tensioning attached thereto.

In FIG. 3 there is seen a sectional circumferential girdle type collar 27 with a bearing lip 28 shown dashed, which may be formed of welded or connected steel angles, plates and the like, and secured to the chimney face 13 by cinching. At the ends of the sectional girdle type connector 27, compression end connectors 16 are attached. These may be formed of welded steel plates, angles, and the like, with a hole to receive the long tension type tie rods 17 and or clevis 24.

Figure 4:
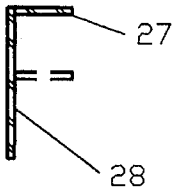
FIG. 4 is a cross sectional view of FIG. 3 showing the bearing lip of the sectional circumferential girdle type connector. The bearing lip can be located at the top or along the height of the collar.

In FIG. 4 is seen a cross section view of FIG. 3 showing the sectional circumferential girdle type collar 27 with the bearing lip 28 shown at the top. The bearing lip may be positioned at various locations on the girdle as shown dashed.

Figure 5:
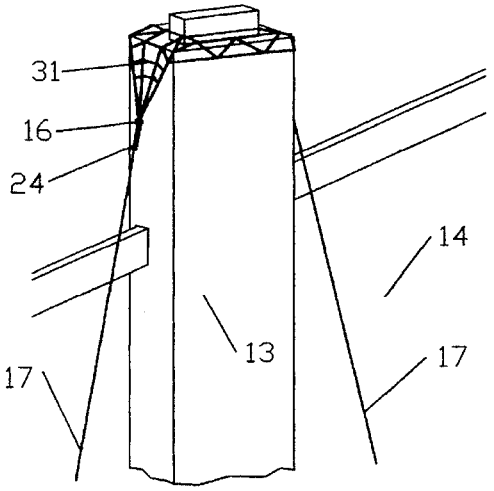
FIG. 5 is a chimney top perspective showing another embodiment of the invention utilizing a webbing harness over the top of the chimney, with tensioning attached thereto.

In FIG. 5 is seen a harness type collar 31 placed over the top of the chimney 13, the harness may be formed of steel plates or webbing materials and the like. At the ends of the harness type collar 31, compression end connectors 16 are attached to receive clevises 24 which are attached to the long tension type tie rods 17.

Figure 6:
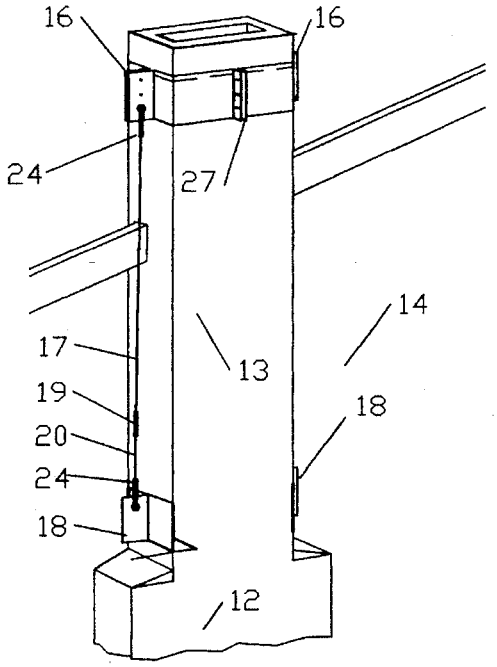
FIG. 6 is a chimney top perspective showing another embodiment of the invention utilizing a plate type gripper, gripping the bottom side of chimney and placed in a mortar joint, at or near the bottom part of the chimney with the tensioning attached thereto and showing the top end of the tensioning attached to one of the collars from FIGS. 2 to 5.
Figure 7:
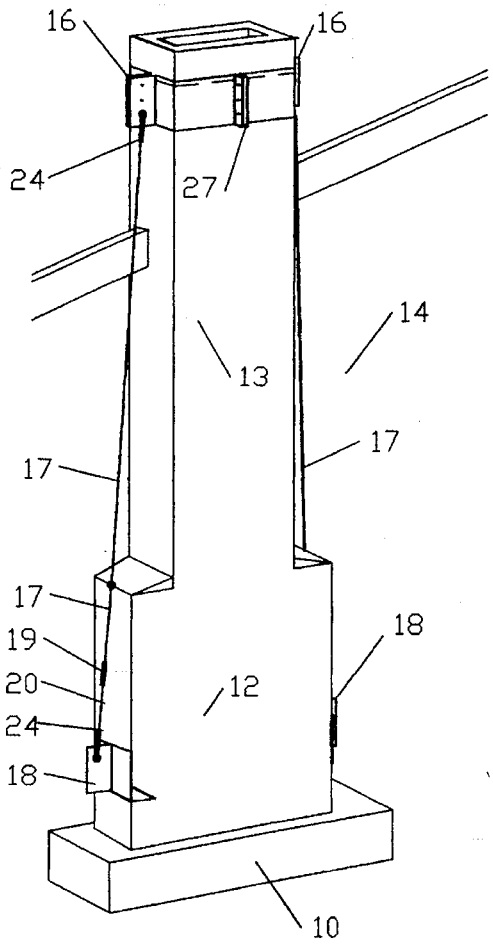
FIG. 7 is a chimney perspective showing another embodiment of the invention utilizing a plate type gripper, gripping the bottom side of chimney material and placed in a mortar joint, along the side of the chimney, at or near the bottom part of the fireplace with the tensioning attached thereto and showing the top end of the tensioning attached to one of the collars from FIGS. 2 to 5.
Figure 8:
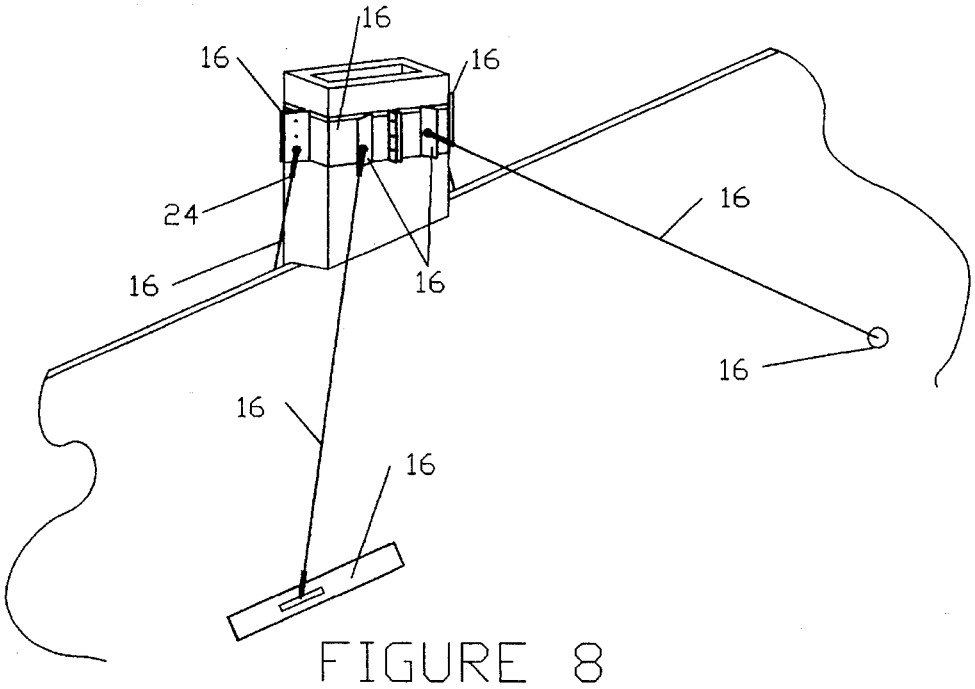
FIG. 8 is a chimney top perspective showing another embodiment of the invention utilizing a diagonal brace member attached to one of the compression collars from FIGS. 2 to 5 and extending away and down toward the structure and attached thereto.

Referring to FIGS. 6 and 7, there is shown two ways of attaching the lower ends of the tensioning members 17 to the lower portions of the chimney. In each of these figures there is seen a chimney wall 13, formed of stone, brick, block and the like, and one of the compression collars 15 from FIGS. 2 to 5. Each of these have a pair of long steel tensioning tie rods 17 which have threaded ends, attached to compression collar 15 with threaded fasteners or clevis 24.

In FIG. 6 is seen a compression collar 27 similar to FIG. 3 at or near the top of the chimney 13. At the ends of the compression collar 17, compression end connectors 16 are attached to receive the long tension type tie rods 17 and or clevis 24. A pair of long steel tension tie rods 17, which rods are threaded at their lower ends into turnbuckle type tensioners 19. A pair of short, threaded steel tension tie rods 20, are threaded into the turnbuckle type tensioner 19 and to clevis type connector 24. The clevis type connectors 24 are attached to a invented bearing element 18 which may be formed of welded or connected steel angles, plates and the like (similar to FIG. 4) which is suitably placed in a mortar joint and engaging the bottom surface of the chimney material.

In FIG. 7 is seen a compression collar 27 similar to FIG. 3 at or near the top of the chimney 13. At the ends of the compression collar 27, compression end connectors 16 are attached to receive the long tension type tie rods 17 and or clevis 24. A pair of long steel tension tie rods 17, which rods are threaded at their lower ends into turnbuckle type tensioners 19. A pair of short, threaded steel tension tie rods 20, are threaded into the turnbuckle type tensioner 19 and to clevis type connector 24. The clevis type connectors 24 are attached to an invented bearing element 18 which may be formed of welded or connected steel angles, plates and the like, (similar to FIG. 4) which is suitably placed in a mortar joint and engaging the bottom surface of the chimney material 12 at a lower level.

Referring to FIGS. 9 through 12 there is shown several alternative ways of attaching the tensioning members to the bottom of the chimney. In each of these alternates there is seen a fireplace foundation 10 which is independent or monolithic to the structures foundation 11, typically formed of concrete. A fireplace exterior wall 12, typical formed of stone, brick, block, or the like is shown with a continuing chimney wall 13, also formed of stone, brick, block, and the like. The exterior wall of the structure is shown at 14. Each of these alternates have a pair of long steel tensioning tie rods 17 with threaded ends, which are threaded into the tensioning elements 19. A pair of short steel threaded rods 20, also threaded into the tensioning elements 19 and to the clevises type connector 24. The tensioning tie rods are attached thereto.

Figure 9:
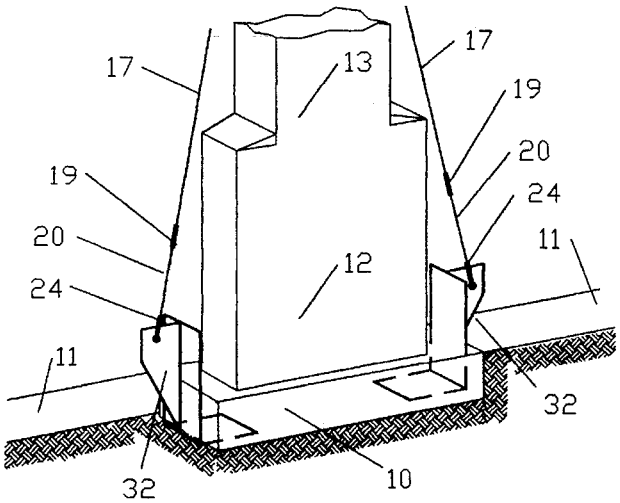
FIG. 9 is a ground level perspective showing another embodiment of the invention utilizing a plate type gripper connector which is placed under the structure or fireplace foundation, with tensioning attached thereto.

In FIG. 9 is seen a pair of long steel tension tie rods 17, which are threaded at their lower ends into turnbuckle type tensioners 19. A pair of short, threaded steel tension tie rods 20, are threaded into the turnbuckle type tensioner 19 and to clevis type connector 24. The clevis type connectors 24 are attached to a foundation gripper connection 32, formed of steel angles, plates, and the like and suitably placed under the fireplace foundation 10 or structure foundation 11.

Figure 10:
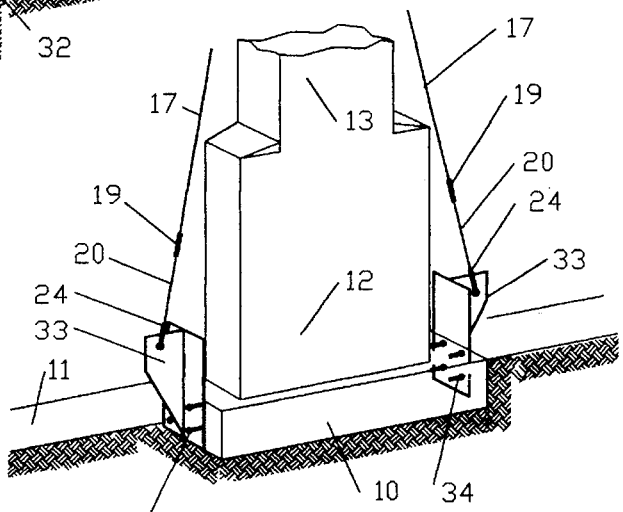
FIG. 10 is a ground level perspective showing another embodiment of the invention utilizing a plate type connector attached to the side of the chimney or structure foundation, with tensioning attached thereto.

In FIG. 10 is seen a pair of long steel tension tie rods 17, which are threaded at their lower ends into turnbuckle type tensioners 19. A pair of short, threaded steel tension tie rods 20, are threaded into the turnbuckle type tensioner 19 and to clevis type connector 24. The clevis type connectors 24 are attached to the foundation side plate assembly 33, formed of steel angles, plates, and the like, and attached to the sides of the fireplace foundation 10 or structure foundation 11, with concrete type fasteners 34 and the like.

Figure 11:
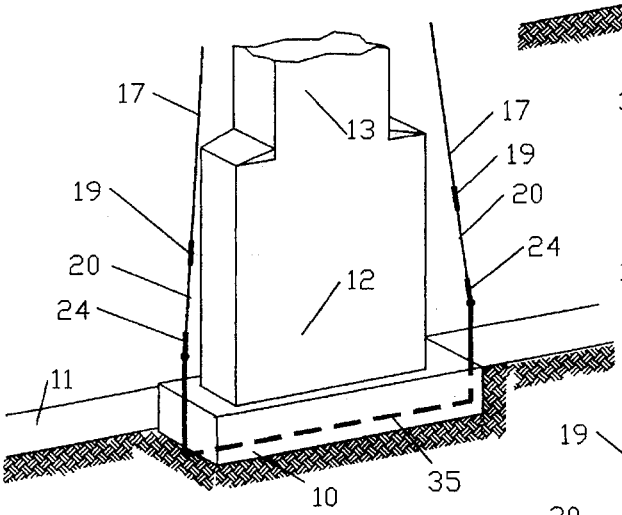
FIG. 11 is a ground level perspective showing another embodiment of the invention utilizing a continuous strap type connector under the chimney foundation, with tensioning attached thereto.

In FIG. 11 is seen a pair of long steel tension tie rods 17, which are threaded at their lower ends into turnbuckle type tensioners 19. A pair of short, threaded steel tension tie rods 20, are threaded into the turnbuckle type tensioner 19 and to clevis type connector 24. The clevis type connectors 24 are attached to a continuous member 35, formed of steel bar, wire rope, strapping material, and the like and suitably placed under the fireplace foundation 10.

Figure 12:
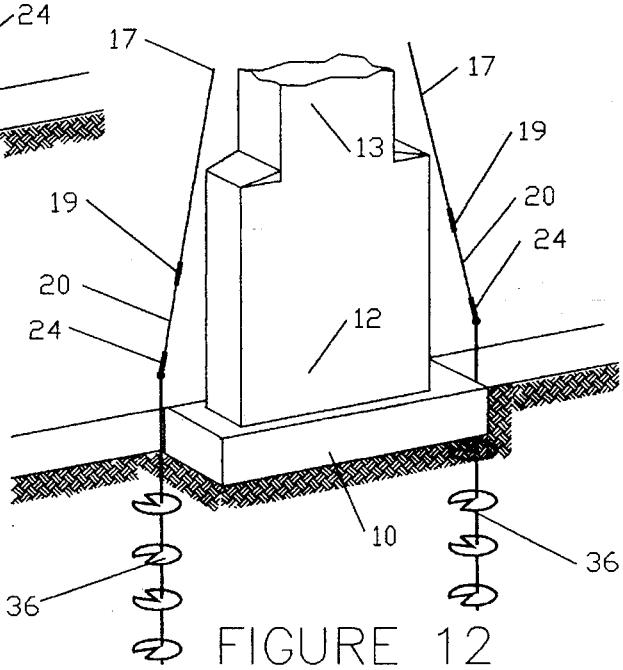
FIG. 12 is a ground level perspective showing another embodiment of the invention utilizing earth type auger anchors embedded into the earth, with tensioning attached thereto.
Figure 13:
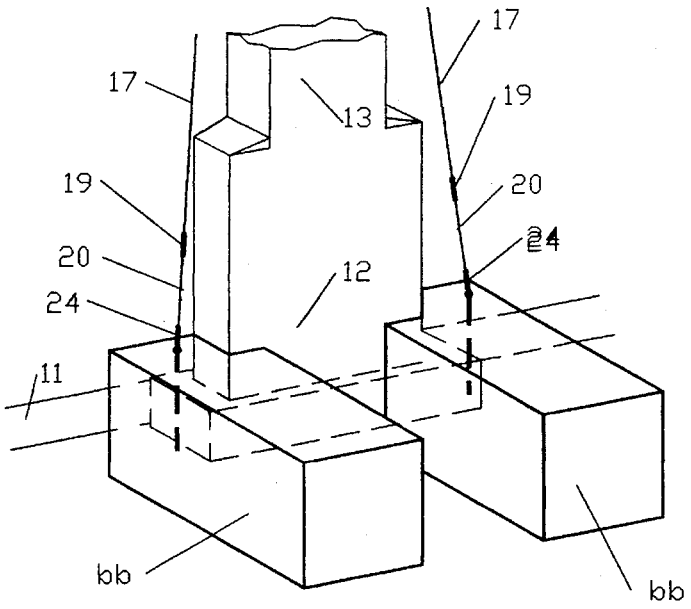
FIG. 13 is a ground level perspective showing another embodiment of the invention utilizing a horizontal extending foundation.
Figure 14:
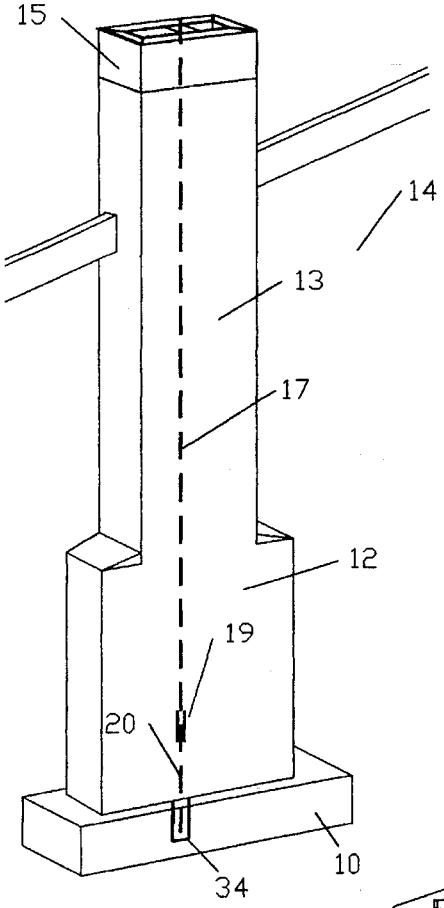
FIG. 14 is a exterior prospective view showing another embodiment where one tensioning member element may be utilized.
Figure 15:
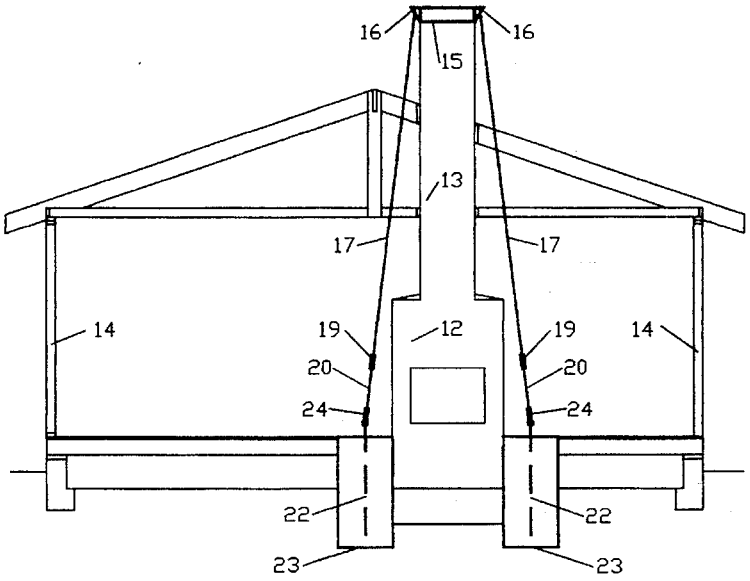
FIG. 15 is a building section showing a typical interior fireplace chimney embodiment at an interior condition showing one of the collars from FIGS. 1 to 5, and showing one of the anchoring means from FIGS. 9 to 13.

In FIG. 12 is seen a pair of long steel tension tie rods 17, which are threaded at their lower ends into turnbuckle type tensioners 19. A pair of short, threaded steel tension tie rods 20, are threaded into the turnbuckle type tensioner 19 and to clevis type connector 24. The clevis type connectors 24 are attached to earth type auger anchors 36, formed of steel and the like, and placed, drilled, or otherwise in the ground adjacent to the fireplace foundation 10 or structure foundation 11.

Other applications, variations, and ramifications of this invention will occur to those skilled in the art upon reading this disclosure. Those are intended to be included within the scope of this invention, as defined in the appended claims.

We claim:

1. Means for reinforcing older stone, brick, block, and the like chimneys which are supported in an elevated position, such as fireplace chimneys wherein such chimneys do not conform to modern building code standards to improve their horizontal fracture resistance in response to seismic, wind and other external lateral force, by improving the horizonal fracture resistance between the component thereof under such condition, which comprises support means affixed at the top of said chimney, one or more elongated tension members attached at their upper ends to said support means and which extend downward and are anchored at a lower level adjacent to the base of said chimney, said tension members being placed under sufficient clamping force to create a vertical internal compression stress within the structural components of said chimney, of between 20 to 30 pounds per square inch, thereby increasing the shear capacity between said units.

2. Means according to claim 1 wherein the said support means is in the form of a circumferential collar positioned over said chimney and wherein said tension members are attached at opposite sides of said collar.

3. Means according to claim 1 wherein the said support means is in the form of a plate collar attached to the side of said chimney and wherein said tension members are attached at opposite sides thereof at their upper ends.

4. Means according to claim 1 wherein the said support means is in the form of a sectional collar with top horizonal bearing elements, which are positioned over the side and top of said chimney and wherein said tension members are attached at opposite sides thereof at their upper ends.

5. Means according to claim 1 wherein the said support means is in the form of a harness collar positioned over the top of said chimney and wherein said tension members are attached at opposite sides thereof at their upper ends.

6. Means according to claim 1 wherein said tension members are elongated tie rods which are adjustably tensioned at intermediate points thereof, and wherein said tie rods are attached at their lower ends to earth anchoring means buried below ground.

7. Means for reinforcing older stone, brick, block, and the like chimneys which are supported in an elevated position, such as fireplace chimneys wherein such chimneys do not conform to modern building code standards to improve their horizontal fracture resistance in response to seismic, wind and other external lateral force, by improving the horizonal fracture resistance between the component thereof under such condition, which comprises support means affixed at the top of said chimney, one or more elongated tension members attached at their upper ends to said support means and which extend downward and are anchored at a lower level adjacent to the base of said chimney, said tension members being placed under sufficient clamping force to create a vertical internal compression stress within the structural components of said chimney, increasing the shear capacity between said units, wherein the said support means is in the form of a sectional girdle collar with interior horizontal bearing elements, which are inserted into said chimney material and at or near the top of said chimney and wherein said tension members are attached at opposite sides of said support means at their upper ends.

8. Means for reinforcing older stone, brick, block, and the like chimneys which are supported in an elevated position, such as fireplace chimneys wherein such chimneys do not conform to modern building code standards to improve their horizontal fracture resistance in response to seismic, wind and other external lateral force, by improving the horizonal fracture resistance between the component thereof under such condition, which comprises support means affixed at the top of said chimney, one or more elongated tension members attached at their upper ends to said support means and which extend downward and are anchored at a lower level adjacent to the base of said chimney, said tension members being placed under sufficient clamping force to create a vertical internal compression stress within the structural components of said chimney, increasing the shear capacity between said units, wherein said tension members are elongated tie rods which are adjustably tensioned at intermediate points thereof, and wherein said tie rods are attached at their lower ends to anchoring means buried below ground level, and positioned under the chimney to produce the desired clamping force.

9. Means for reinforcing older stone, brick, block, and the like chimneys which are supported in an elevated position, such as fireplace chimneys wherein such chimneys do not conform to modern building code standards, to improve their horizontal fracture resistance in response to seismic, wind and other external lateral forces, by improving the horizonal fracture resistance between the components thereof under such condition, which comprises support means affixed at the top of said chimney, one or more elongated tension members attached at their upper ends to said support means and which extend downward and are anchored at a lower level adjacent to the base of said chimney, said tension members being placed under sufficient clamping force to create a vertical internal compression stress within the structural components of said chimney, increasing the shear capacity between said units, wherein said tension members are elongated tie rods which are adjustably tensioned at intermediate points thereof, and wherein said tie rods are attached at their lower ends to anchoring means buried below ground level positioned under the fireplace foundation.

10. Means for reinforcing older stone, brick, block, and the like chimneys which are supported in an elevated position, such as fireplace chimneys wherein such chimneys do not conform to modern building code standards to improve their horizontal fracture resistance in response to seismic, wind and other external lateral forces, by improving the horizonal fracture resistance between the components thereof under such condition, which comprises support means affixed at the top of said chimney, one or more elongated tension members attached at their upper ends to said support means and which extend downward and are anchored at a lower level adjacent to the base of said chimney, said tension members being placed under sufficient clamping force to create a vertical internal compression stress within the structural components of said chimney, increasing the shear capacity between said units, wherein said tension members are elongated tie rods which are adjustably tensioned at intermediate points thereof, and wherein said tie rods are attached at their lower ends to anchoring means which extend under the base of the fireplace to provide the desired clamping force.

11. Means for reinforcing older stone, brick, block, and the like chimneys which are supported in an elevated position, such as fireplace chimneys wherein such chimneys do not conform to modern building code standards to improve their horizontal fracture resistance in response to seismic, wind and other external lateral forces, by improving the horizonal fracture resistance between the components thereof under such conditions, which comprises support means affixed at the top of said chimney, one or more elongated tension members attached at their upper ends to said support means and which extend downward and are anchored at a lower level adjacent to the base of said chimney, said tension members being placed under sufficient clamping force to create a vertical internal compression stress within the structural components of said chimney, increasing the shear capacity between said units, wherein said tension members are a single elongated tie rod which is adjustable tensioned at intermediate points thereof, and wherein said tie rod is attached at its lower end by attachment to the fireplace structure.

12. A method for improving the horizontal fracture resistance of older chimneys formed of units of stone, brick, or block such as fireplace chimneys, which comprises placing such chimneys and the structural components thereof under a clamping action by tension applied thereto between the top thereof and the base thereof, which creates a vertical internal compression stress within the structural components of the chimney, of between 20 to 30 pounds per square inch thereby, increasing the shear capacity between said units.

13. A method according to claim 12 wherein said clamping action is created by one or more tension members attached at the top of the chimney at the upper end and at or near the ground level at the lower end.

* * * * *

UNITED STATES PATENT AND TRADEMARK OFFICE

CERTIFICATE OF CORRECTION

PATENT NO. : 5,517,793

DATED : May 21, 1996

INVENTOR(S) : Flores et al.

It is certified that error appears in the above-indentified patent and that said Letters Patent is hereby corrected as shown below:

The title page should be deleted and substitute therefor the attached title page.

Signed and Sealed this

Sixth Day of August, 1996

*Attest:*

*Attesting Officer*

BRUCE LEHMAN

*Commissioner of Patents and Trademarks*

US005517793A

United States Patent [19]

Flores et al.

[11] Patent Number: 5,517,793

[45] Date of Patent: May 21, 1996

[54] SYSTEM FOR PROTECTING FIREPLACES AND CHIMNEYS FROM ADVERSE SEISMIC OR WIND FORCES

[76] Inventors: Raymond H. Flores, 2268 Lagoon View Dr., San Diego, Calif. 92007; Douglas R. Antolini, 3325 Mt. Everest Blvd., San Diego, Calif. 92111-3939

[21] Appl. No.: 998,366

[22] Filed: Dec. 30, 1992

[51] Int. Cl.[6] ..... E04B 1/98

[52] U.S. Cl. ..... 52/167.1; 52/148; 52/223.1; 52/223.4

[58] Field of Search ..... 52/167 R, 167 CB, 52/223.1, 223.4, 223.5, 148, 166, 745.04, 745.09, 745.17, 745.18

[56] References Cited

U.S. PATENT DOCUMENTS

| | | | |
|---|---|---|---|
| 501,811 | 7/1893 | Stombaugh | 52/223.1 X |
| 937,299 | 10/1909 | Foster | 52/223.4 |
| 1,250,167 | 12/1917 | Head | 52/223.4 X |
| 2,401,799 | 6/1946 | Riemenschneider et al. | 52/223.4 X |
| 2,923,382 | 2/1960 | Heldstab | 52/148 |
| 3,174,589 | 3/1965 | Chen | 52/167 R |
| 3,237,355 | 3/1966 | McWtyre | 52/148 |
| 3,780,480 | 12/1973 | Cvijanovic et al. | 52/223.4 |
| 4,321,776 | 3/1982 | Delight | 52/167 R |
| 5,085,026 | 2/1992 | McGill et al. | 52/167 R X |

*Primary Examiner*—Philip C. Kannan

[57] ABSTRACT

A system for improving the horizontal fracture resistance of older chimneys and fireplaces comprised of units of brick, stone, and the like, in response to seismic, wind, and other external lateral forces, by placing the units under a vertical internal compression stress, increasing the shear capacity between the units, by means of a clamping action. Said clamping action is the results of providing one or more elongated members attached to an element affixed at the top of the chimney and an element affixed at a lower level, said elongated members being placed under predetermined tension creating a vertical internal compression stress.

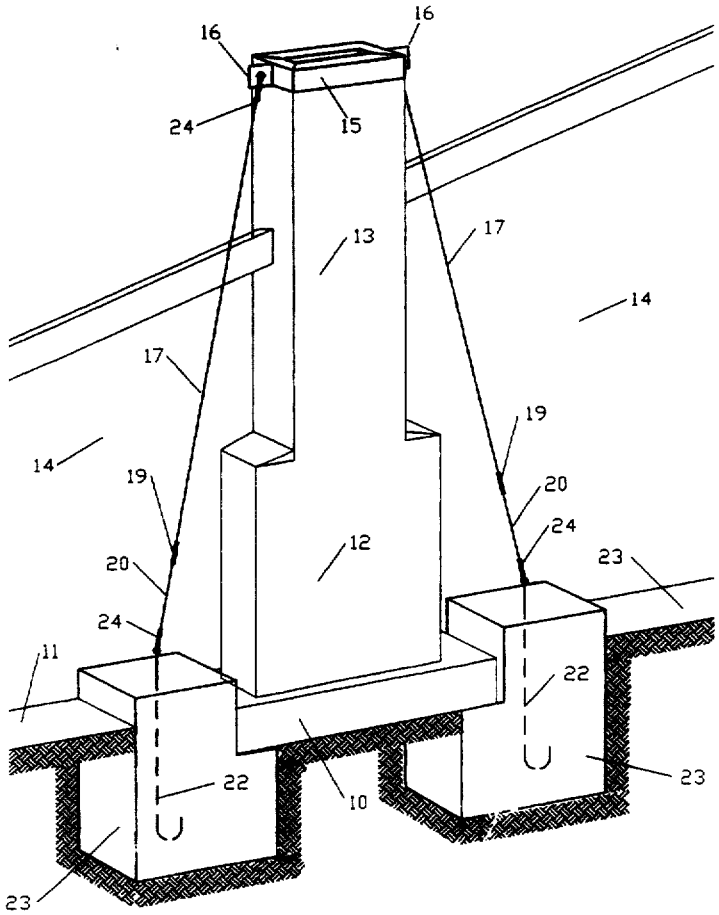

13 Claims, 5 Drawing Sheets